US007293630B1

(12) United States Patent
Trebec

(10) Patent No.: US 7,293,630 B1
(45) Date of Patent: Nov. 13, 2007

(54) LADDER STABILIZATION DEVICE

(76) Inventor: Frank Trebec, 349 CR 4557, Winnsboro, TX (US) 75494

( * ) Notice: Subject to any disclaimer, the term of this patent is extended or adjusted under 35 U.S.C. 154(b) by 0 days.

(21) Appl. No.: 11/431,325

(22) Filed: May 10, 2006

(51) Int. Cl.
*E06C 7/00* (2006.01)

(52) U.S. Cl. ..... 182/172; 182/204

(58) Field of Classification Search ..... 182/172, 182/204, 25, 165, 176
See application file for complete search history.

(56) References Cited

U.S. PATENT DOCUMENTS

| | | | | |
|---|---|---|---|---|
| 3,508,628 | A * | 4/1970 | Conrad | 182/172 |
| 3,568,798 | A * | 3/1971 | Pierce | 182/172 |
| 4,565,262 | A * | 1/1986 | Hawkins | 182/116 |
| 4,899,849 | A * | 2/1990 | Levi et al. | 182/172 |
| 5,423,397 | A | 6/1995 | Boughner | |
| 5,551,529 | A | 9/1996 | Molitor | |
| 5,868,222 | A * | 2/1999 | Charbonneau | 182/172 |
| 5,915,498 | A | 6/1999 | Figliuzzi | |
| 6,029,774 | A | 2/2000 | Cothern | |
| 6,044,930 | A | 4/2000 | Hayman | |
| 6,152,262 | A | 11/2000 | Jung | |
| 6,408,983 | B1 | 6/2002 | Widurski | |
| 6,527,084 | B2 * | 3/2003 | Hrincu | 182/172 |
| 6,672,427 | B1 | 1/2004 | Sheffield | |
| 6,691,825 | B2 | 2/2004 | Haig | |
| 6,745,870 | B2 | 6/2004 | Smith | |
| 6,799,660 | B1 * | 10/2004 | Crawford | 182/200 |
| 6,837,338 | B2 | 1/2005 | Grover | |
| 6,851,518 | B1 | 2/2005 | Walker | |
| 2002/0074187 | A1 * | 6/2002 | Bendle et al. | 182/172 |

* cited by examiner

*Primary Examiner*—Alvin Chin-Shue
(74) *Attorney, Agent, or Firm*—Lathrop & Gage LC

(57) ABSTRACT

Stabilization devices for use with folding and/or extension ladders and methods of stabilizing ladders are disclosed herein. A stabilization device of one embodiment includes an upper shaft for operative coupling to a ladder's upper end. An outer leg has a lower end and an upper end with an aperture for receiving the shaft. An inner leg is configured for telescoping extension relative to the outer leg, and means are included for maintaining the inner leg at various positions. A foot is at the inner leg's lower end. A lower bracket selectively attaches to a ladder leg. A lower coupler selectively attaches to the outer leg. A lower strut has a first end attachable to the lower bracket and a second end attachable to the lower coupler to operatively couple the outer leg to the ladder leg and maintain a distance between the outer leg and the ladder leg.

17 Claims, 9 Drawing Sheets

LADDER STABILIZATION DEVICE

BACKGROUND

Falls from ladders cause may injuries every year. While some of these injuries are minor, many are very severe and cause paralysis or death. A contributing cause to many of these falls is a loss of balance caused by lateral movement of the ladder. Especially for long ladders, the normal ladder width is not sufficient to prevent lateral movement when a user is at the ladder's upper end. There are many reasons that ladders are not constructed wider, including (among other things) manufacturing costs and shipping and storage considerations. As many ladders are already in the hands of those needing a ladder and countless other ladders have already been constructed and shipped for sale, a stabilization device that works with pre-existing ladders could be easily integrated into public use and could help prevent many injuries.

SUMMARY

The devices disclosed below are improvements in the art, as they provide existing ladders with increased lateral stability for preventing falls and increasing safety. These devices are useful, for example, with existing or conventional ladders, such as folding and/or extension ladders.

In an embodiment disclosed herein, there is provided a stabilization device that includes an upper shaft for operative coupling to an upper end of a ladder. An elongate outer leg has upper and lower ends, and its upper end has an aperture for receiving the upper shaft in a generally horizontal direction. An elongate inner leg is positioned in the outer leg and configured for telescoping extension relative to the outer leg, and means are included for maintaining the inner leg at a plurality of predetermined positions relative to the outer leg. A foot is coupled to a lower end of the inner leg for placement on a ground surface. A lower bracket is included for attachment to a leg of the ladder, and a lower coupler is included for attachment to the outer leg. A lower strut has a first end being attachable to the lower bracket and a second end being attachable to the lower coupler to operatively couple the outer leg to the ladder leg and maintain a preselected distance between the outer leg and the ladder leg.

In another embodiment, there is disclosed a method of stabilizing a ladder. The method includes the steps of (1) operatively coupling an upper shaft to an upper end of the ladder; (2) rotatably coupling the upper shaft to an upper end of an elongate outer leg; (3) coupling a lower bracket to a leg of the ladder; (4) coupling a lower coupler to the outer leg; (5) coupling a first end of a lower strut to the lower bracket; (6) coupling a second end of the lower strut to the lower coupler; and (7) telescopically adjusting an elongate inner leg at least partially positioned in the outer leg so that a foot coupled to a lower end of the inner leg is positioned on a ground surface.

BRIEF DESCRIPTION OF THE DRAWINGS

Attention is now directed to the drawings where like or corresponding numerals and/or characters indicate like or corresponding components. In the drawings.

DETAILED DESCRIPTION

Figure 1:
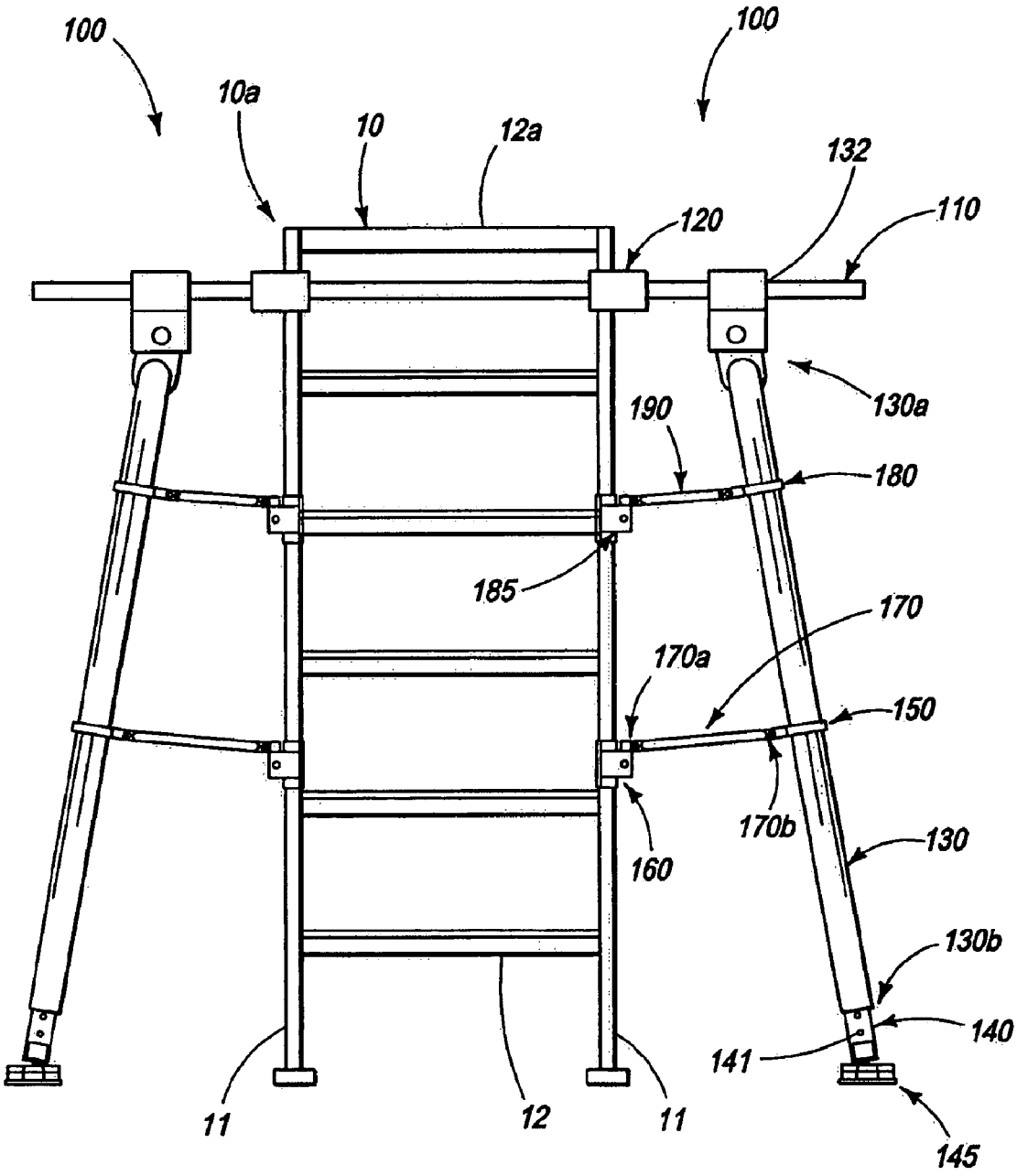
FIG. 1 is a front view of a ladder stabilization device according to an embodiment attached to a stepladder.

FIGS. 1 through 4 show a ladder stabilization device 100 attached to a stepladder (also referred to herein as a folding ladder) 10. The stepladder 10 is exemplary of ladders on which the device 100 may be employed, and has opposed legs 11 and steps 12 spanning therebetween. In accord with most existing and contemporary stepladders (and unlike most extension ladders,) there is not an aperture passing through the ladder legs 11 and an uppermost step 12*a* (as this aperture would otherwise appear in FIG. 2).

Figure 2:
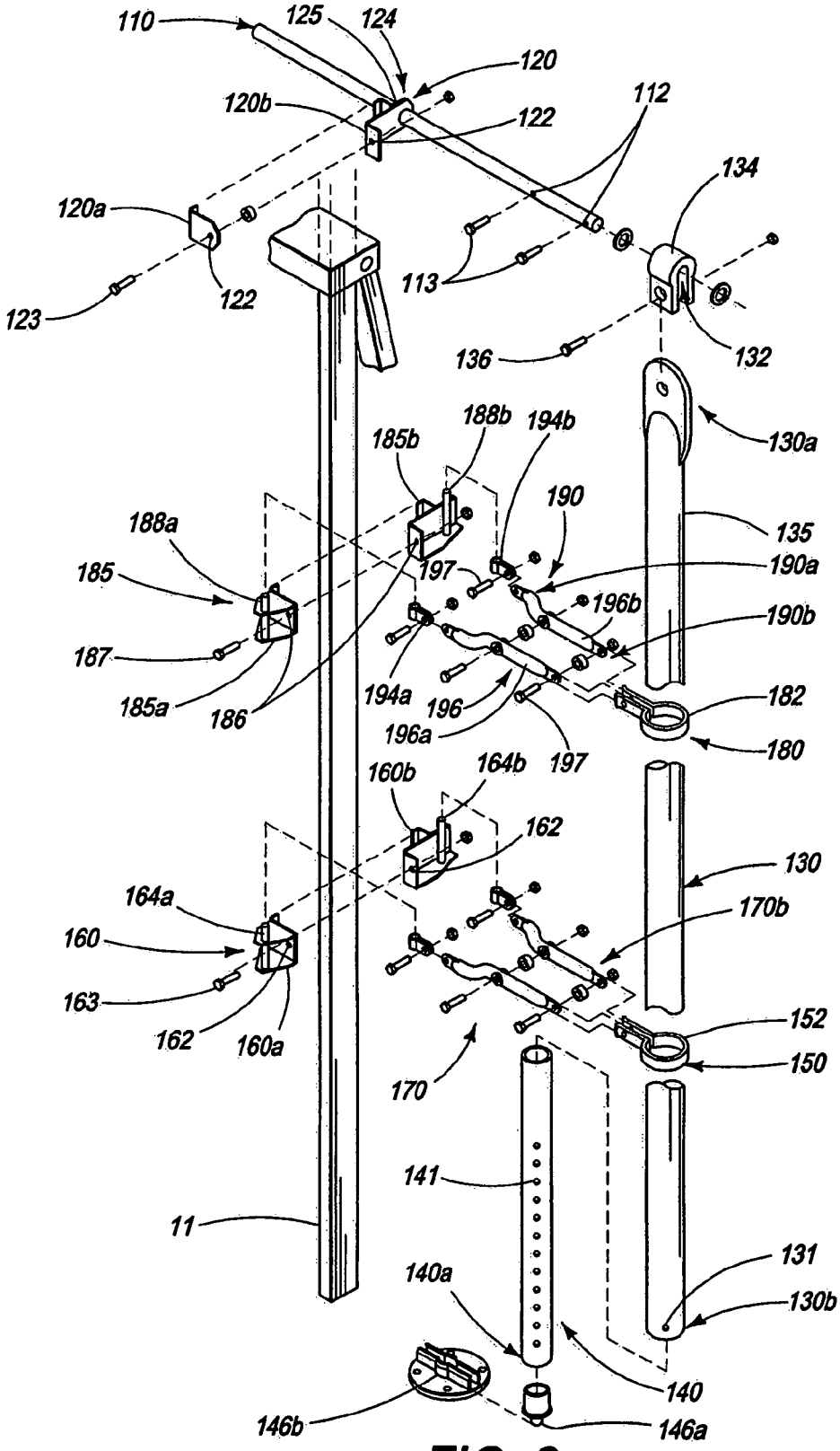
FIG. 2 is an exploded view of the ladder stabilization device and ladder of FIG. 1.
Figure 3:
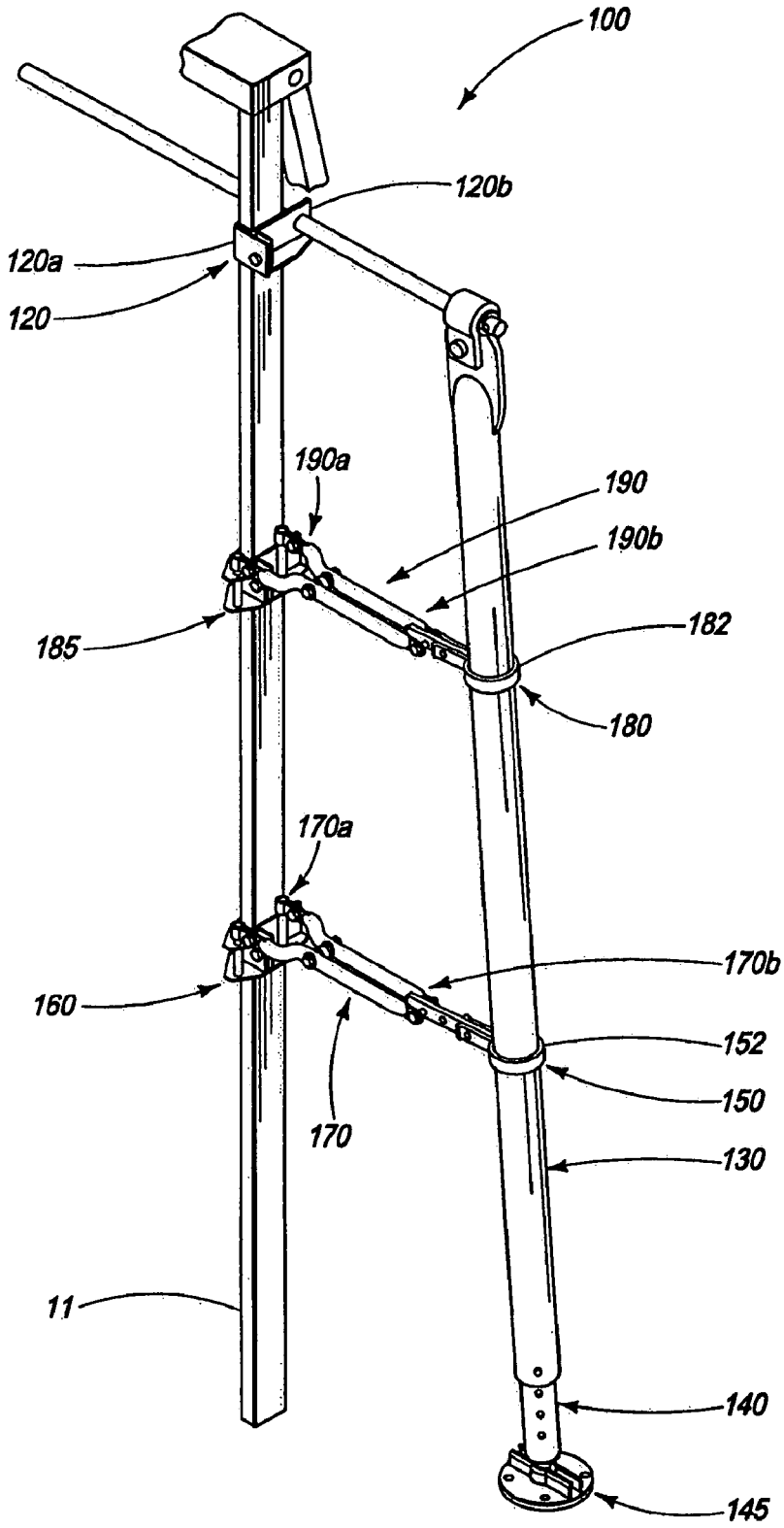
FIG. 3 is a perspective view of the ladder stabilization device and ladder of FIG. 1.

The stabilization device 100 includes an upper shaft 110 for operative coupling to an upper end 10*a* of the stepladder 10. An upper bracket 120 may attach to the upper shaft 110 and one of the ladder legs 11 to operatively couple the upper shaft 110 and the ladder upper end 10*a*. As shown in FIGS. 2 and 3, the upper bracket 120 may have separable first and second sections 120*a*, 120*b* configured for collectively encircling one of the ladder legs 11 when combined (FIG. 3). The upper bracket first and second sections 120*a*, 120*b* define aligned holes 122, and a bolt 123 (FIG. 2) may selectively pass through the aligned holes 122 to combine the upper bracket first and second sections 120*a*, 120*b* and couple the first and second sections 120*a*, 120*b* to one of the ladder legs 11 through friction. One of the upper bracket sections 120*a*, 120*b* has a flange 124 with a hole 125 for selectively receiving the upper shaft 110 to operatively couple the upper shaft 110 and the ladder upper end 10*a*.

Figure 5A:
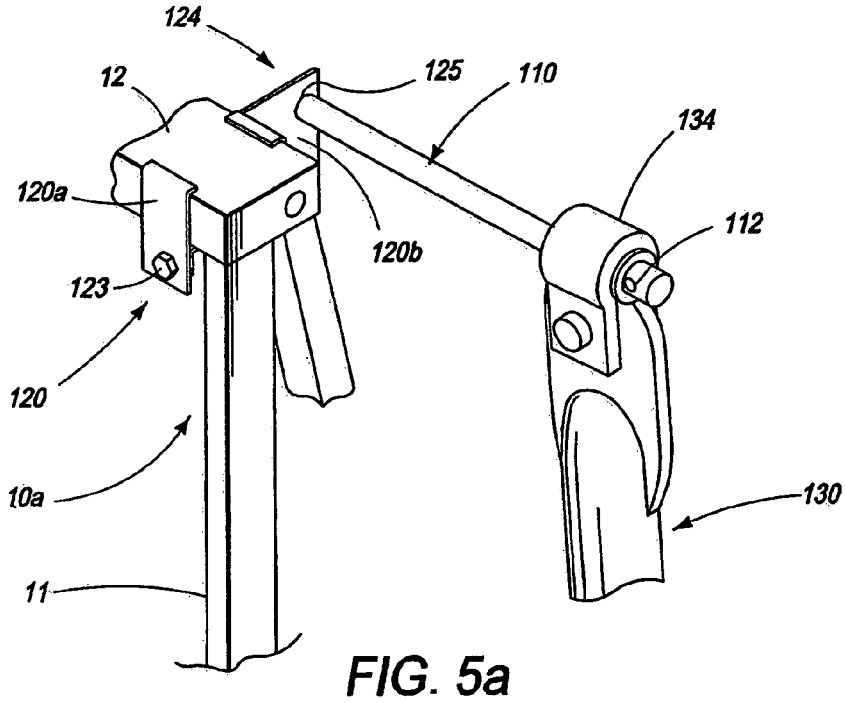
FIG. 5*a* is a broken view of an upper bracket attached to a ladder step according to an embodiment.
Figure 5B:
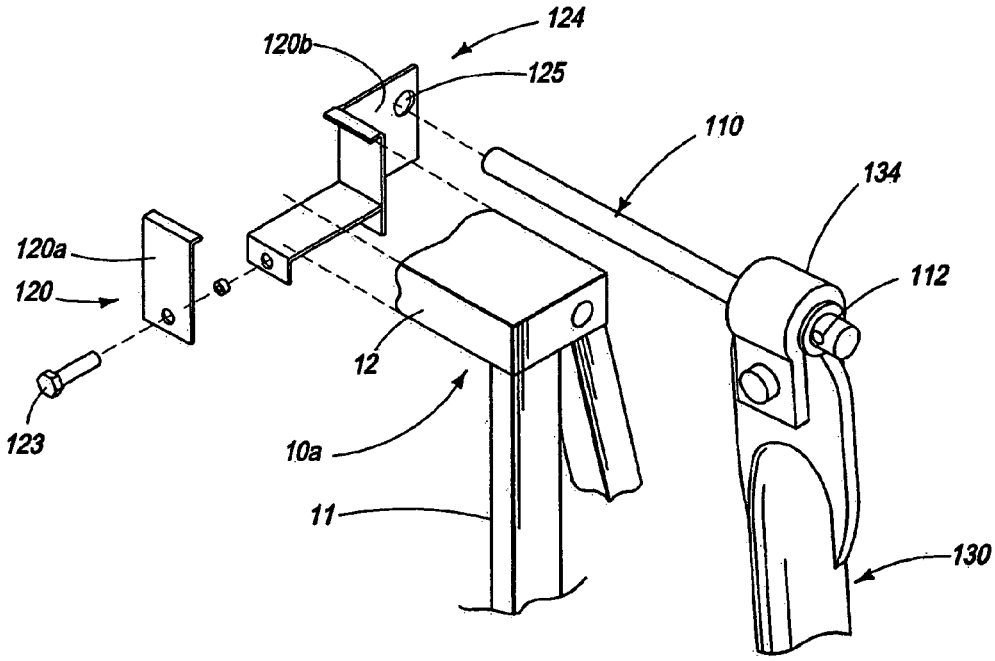
FIG. 5*b* is an exploded view of FIG. 5*a*.

As alternately shown in FIGS. 5*a* and 5*b*, the upper bracket 120 may have separable first and second sections 120*a*, 120*b* configured for collectively encircling one of the ladder steps 12 when combined (FIG. 5*a*).

An elongate outer leg 130 presents upper and lower ends 130*a*, 130*b*, and the upper end 130*a* has an aperture 132 for receiving the upper shaft 110 in a generally horizontal direction. As best shown in FIG. 2, the aperture 132 at the outer leg upper end 130*a* is defined by a strap 134 sized to receive the upper shaft 110. The strap 134 may be rotatably coupled to a tubular portion 135 of the outer leg 130, such as by a bolt 136 or another fastener. The upper shaft 110 is shown in FIG. 2 to have two holes 112 spaced apart to receive the outer leg strap 134 therebetween, and fasteners 113 (e.g., bolts, pins, etc.) are shown to pass through the holes 112 when the outer leg strap 134 is between the holes 112 to couple the upper shaft 110 to the outer leg strap 134. Other methods of coupling the outer leg strap 134 and the upper shaft 110 are possible, however, and all traditional coupling methods are contemplated herein.

An elongate inner leg 140 is positioned in the outer leg 130 and configured for telescoping extension relative to the outer leg 130. For example, a pin (not shown) may pass through a hole 141 in the inner leg 140 and a hole 131 in the outer leg 130 to adjust the extension of the inner leg 140 (FIG. 2). Though not shown, various clamps may alternately be used to adjust the extension of the inner leg 140, the outer leg 130 may rest on a pin passing through one of the holes 141 without use of hole 131, or a hinged or spring-operated pin may be fixedly attached to the outer leg 130 for mating with one of the holes 141. Throughout the drawings, a foot 145 is shown coupled to a lower end 140*a* of the inner leg 140 for placement on a ground surface. The foot 145 may be coupled to the inner leg lower end 140*a* by a ball 146*a* and socket 146*b* connection (FIG. 2), by a hinge, or by another appropriate coupler.

A lower coupler 150 is included for attachment to the outer leg 130. As shown throughout the drawings, the lower coupler 150 may include a strap 152 sized to encircle the outer leg 130. Other known coupling devices may be used as the lower coupler 150.

Figure 4:
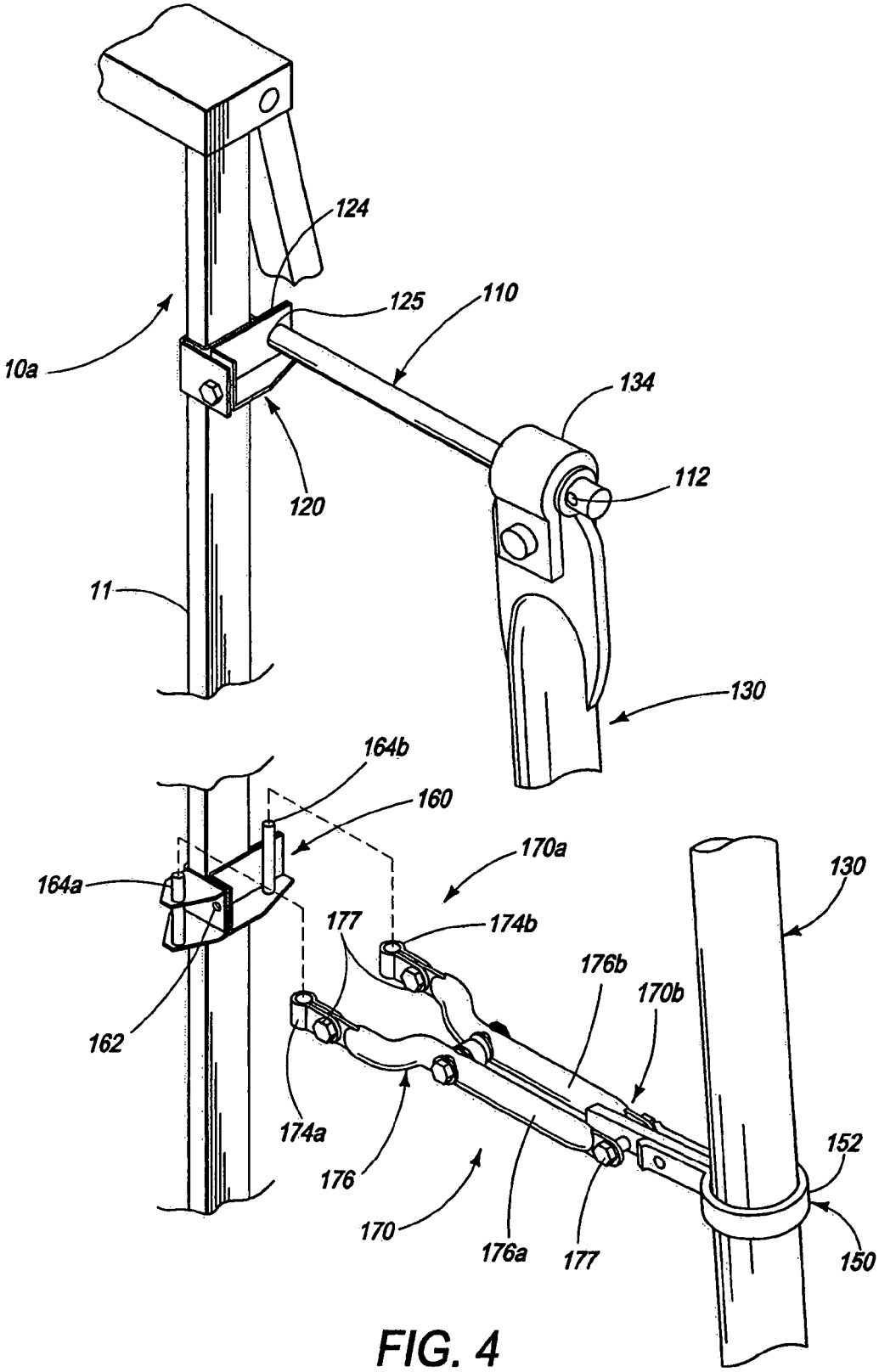
FIG. 4 is a broken view of the ladder stabilization device and ladder of FIG. 1.

A lower bracket 160 is included for attachment to one of the ladder legs 11. As shown in FIGS. 2 and 3, the lower bracket 160 may have separable first and second sections 160*a*, 160*b* configured for collectively encircling one of the ladder legs 11 when combined (FIG. 3). The lower bracket first and second sections 160*a*, 160*b* define aligned holes 162, and a bolt 163 (FIG. 2) may selectively pass through the aligned holes 162 to combine the lower bracket first and second sections 160*a*, 160*b* to one of the ladder legs 11 through friction. The lower bracket 160 has first and second upwardly-extending pins 164*a*, 164*b*, as best shown in FIG. 4.

A lower strut 170 has first and second ends 170*a*, 170*b*. The lower strut first end 170*a* is attachable to the lower bracket 160, and the lower strut second end 170*b* is attachable to the lower coupler 150 to operatively couple the outer leg 130 to the ladder leg 11 and maintain a preselected distance between the outer leg 130 and the ladder leg 11. The lower strut first end 170*a* is shown in FIG. 4 as having first and second straps 174*a*, 174*b* for encircling the first and second upwardly-extending pins 164*a*, 164*b*, respectively, to couple the lower strut 170 to the lower bracket 160. The lower strut 170 has an elongate portion 176 rotatably coupled to the first and second straps 174*a*, 174*b* and rotatably coupled to the lower coupler 150 (e.g., by fasteners 177). As shown in FIG. 2, the lower strut elongate portion 176 may include two or more distinct elongate members 176*a*, 176*b*. Though it is presently preferred that the first and second straps 174*a*, 174*b* are constructed of rubber, they may alternately be constructed of plastic, composite, metal, or any other appropriate material. It is also presently preferred that the upper shaft 110 and the lower strut 170 are dimensioned to maintain the outer leg 130 at a 15 to 30 degree angle (and even more preferably, approximately a 20 degree angle) offset from the vertical when the lower strut 170 is attached to the lower bracket 160 and the lower coupler 150 and the upper shaft 110 is coupled to the outer leg 130; alternate dimensions may be used, however.

An intermediate coupler 180 is included for attachment to the outer leg 130. As shown throughout the drawings, the intermediate coupler 180 may include a strap 182 sized to encircle the outer leg 130. Other known coupling devices may alternately be used, however. The intermediate coupler 180 may or may not be substantially similar to the lower coupler 150.

An intermediate bracket 185 is included for attachment to one of the ladder legs 11. As shown in FIGS. 2 and 3, the intermediate bracket 185 may have separable first and second sections 185*a*, 185*b* configured for collectively encircling one of the ladder legs 11 when combined (FIG. 3). The intermediate bracket first and second sections 185*a*, 185*b* define aligned holes 186, and a bolt 187 (FIG. 2) may selectively pass through the aligned holes 186 to combine the intermediate bracket first and second sections 185*a*, 185*b* to one of the ladder legs 11 through friction. The intermediate bracket 185 has first and second upwardly-extending pins 188*a*, 188*b*, as best shown in FIG. 2. The intermediate bracket 185 may or may not be substantially similar to the lower bracket 160.

An intermediate strut 190 has first and second ends 190*a*, 190*b*. The intermediate strut first end 190*a* is attachable to the intermediate bracket 185, and the intermediate strut second end 190*b* is attachable to the intermediate coupler 180 to operatively couple the outer leg 130 to the ladder leg 11 and maintain a preselected distance between the outer leg 130 and the ladder leg 11. The intermediate strut first end 190*a* is shown in FIG. 2 as having first and second straps 194*a*, 194*b* for encircling the first and second upwardly-extending pins 188*a*, 188*b*, respectively, to couple the intermediate strut 190 to the intermediate bracket 185. The intermediate strut 190 has an elongate portion 196 rotatably coupled to the first and second straps 194*a*, 194*b* and rotatably coupled to the intermediate coupler 180 (e.g., by fasteners 197). As shown in FIG. 2, the intermediate strut elongate portion 196 may include two or more distinct elongate members 196*a*, 196*b*. Though it is presently preferred that the first and second straps 194*a*, 194*b* are constructed of rubber, they may alternately be constructed of plastic, composite, metal, or any other appropriate material. It is also presently preferred that the upper shaft 110, the lower strut 170, and the intermediate strut 190 are dimensioned to maintain the outer leg 130 at a 15 to 30 degree angle (and even more preferably, approximately a 20 degree angle) offset from the vertical when (1) the lower strut 170 is attached to the lower bracket 160 and the lower coupler 150, (2) the intermediate strut 190 is attached to the intermediate bracket 180 and the intermediate coupler 185, and (3) the upper shaft 110 is coupled to the outer leg 130; alternate dimensions may be used, however. The intermediate strut 190 may or may not be substantially similar to the lower strut 170. However, the intermediate strut 190 is preferably shorter than the lower strut 170, as shown in FIG. 1 and discussed above.

As (1) the lower strut 170 is rotatable about the lower coupler 150 when not attached to the lower bracket 160 (see above), and (2) the intermediate strut 190 is rotatable about the intermediate coupler 180 when not attached to the intermediate bracket 185 (see above), the lower strut 170 and the intermediate strut 190 may be rotated generally parallel to the outer leg 130 when not coupled to the lower and intermediate brackets 160, 185. Additionally, because the outer leg strap 134 is rotatably coupled to the outer leg tubular portion 135 (see above), the outer leg 130 may be rotated inwardly toward (and in some embodiments generally parallel to) the ladder leg 11 when the lower strut 170 and the intermediate strut 190 are not attached to the lower and intermediate brackets 160, 185. This configuration may be particularly useful for storage or transportation purposes.

In an exemplary method of use, the ladder 10 may be stabilized by operatively coupling the upper shaft 110 to the ladder upper end 10*a* (e.g., through the upper bracket 120), rotatably coupling the upper shaft 110 to the outer leg upper end 130*a* (e.g., through the outer leg strap 134), coupling the lower bracket 160 to the ladder leg 11, coupling the lower coupler 150 to the outer leg 130, coupling the lower strut first end 170*a* to the lower bracket 160, coupling the lower strut second end 170*b* to the lower coupler 150, coupling the intermediate bracket 185 to the ladder leg 11, coupling the intermediate coupler 180 to the outer leg 130, coupling the intermediate strut first end 190*a* to the intermediate bracket 185, coupling the intermediate strut second end 190*b* to the intermediate coupler 180, and telescopically adjusting the inner leg 140 relative to the outer leg 130 so that the foot 145 is positioned on a ground surface. To store or move the ladder 10 and the ladder stabilization device 100, the lower strut 170 and the lower bracket 160 may be uncoupled, the lower strut 170 may be rotated about the lower coupler 150 so that the lower strut 170 is generally parallel to and adjacent the outer leg 130, the intermediate strut 190 and the intermediate bracket 185 may be uncoupled, the intermediate strut 190 may be rotated about the intermediate coupler 180 so that the intermediate strut 190 is generally parallel to and adjacent the outer leg 130, and the outer leg 130 may be rotated about the upper shaft 110. As can be seen in FIG. 1, two ladder stabilization devices 100 may be used for a single ladder 10, and the two stabilization devices 100 may share a single upper shaft 110.

FIGS. 6 through 9 show a ladder stabilization device 100' attached to an extension ladder 20. The extension ladder 20 has opposed legs 21 and steps 22 spanning therebetween as is well known in the art. In accord with most extension ladders currently on the market (an unlike most folding ladders,) there is an aperture 23 passing through the ladder legs 21 and an uppermost step 22*a*. The ladder stabilization device 100' is substantially similar to the ladder stabilization device 100 shown in FIGS. 1 through 4, though the upper bracket 120 is not required in the ladder stabilization device 100'. Importantly, the upper shaft 110 is sized to pass through the ladder aperture 23 to operatively couple the upper shaft 110 and an upper end 20*a* of the ladder 20.

Figure 6:
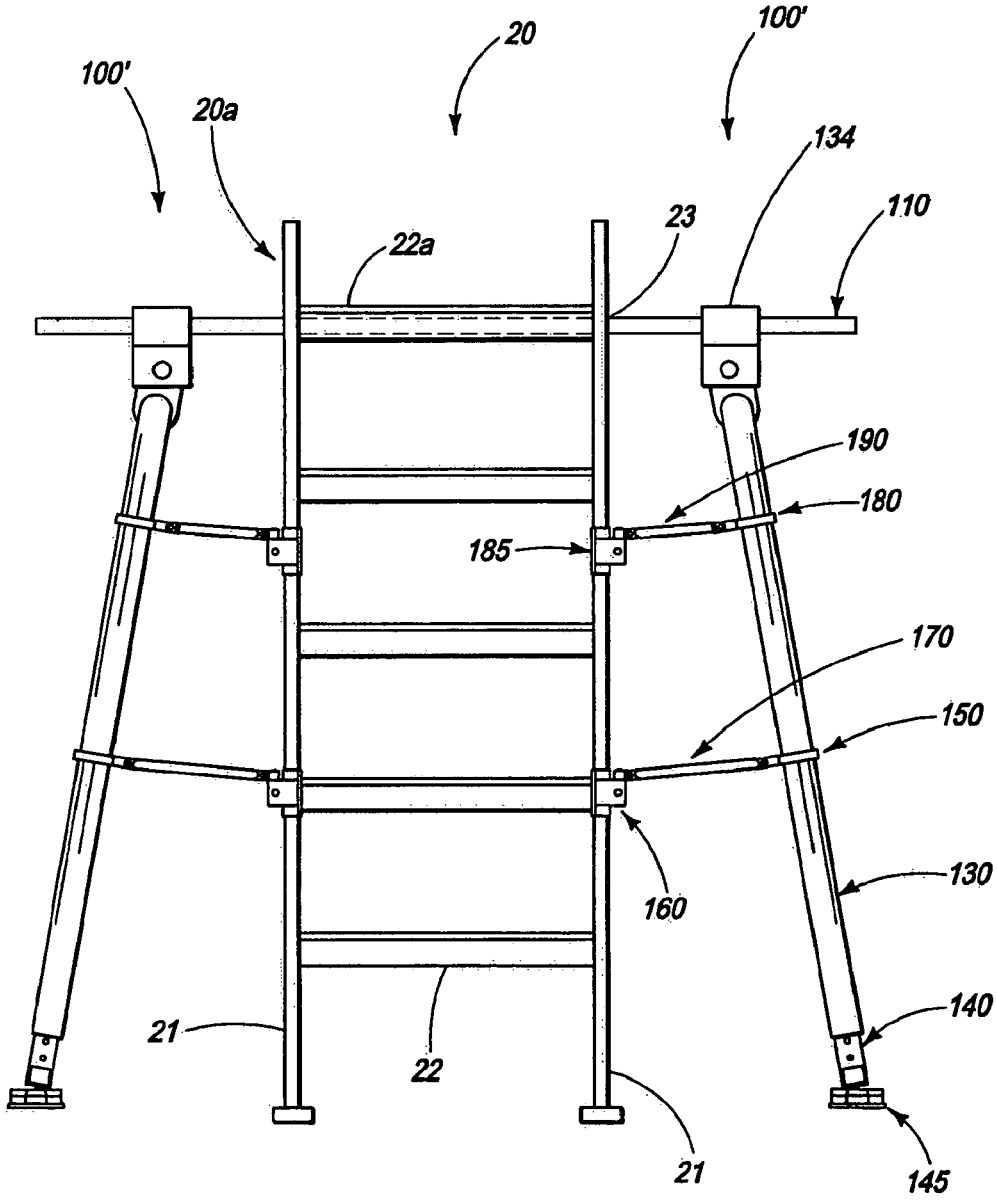
FIG. 6 is a front view of a ladder stabilization device according to an embodiment attached to an extension ladder.
Figure 7:
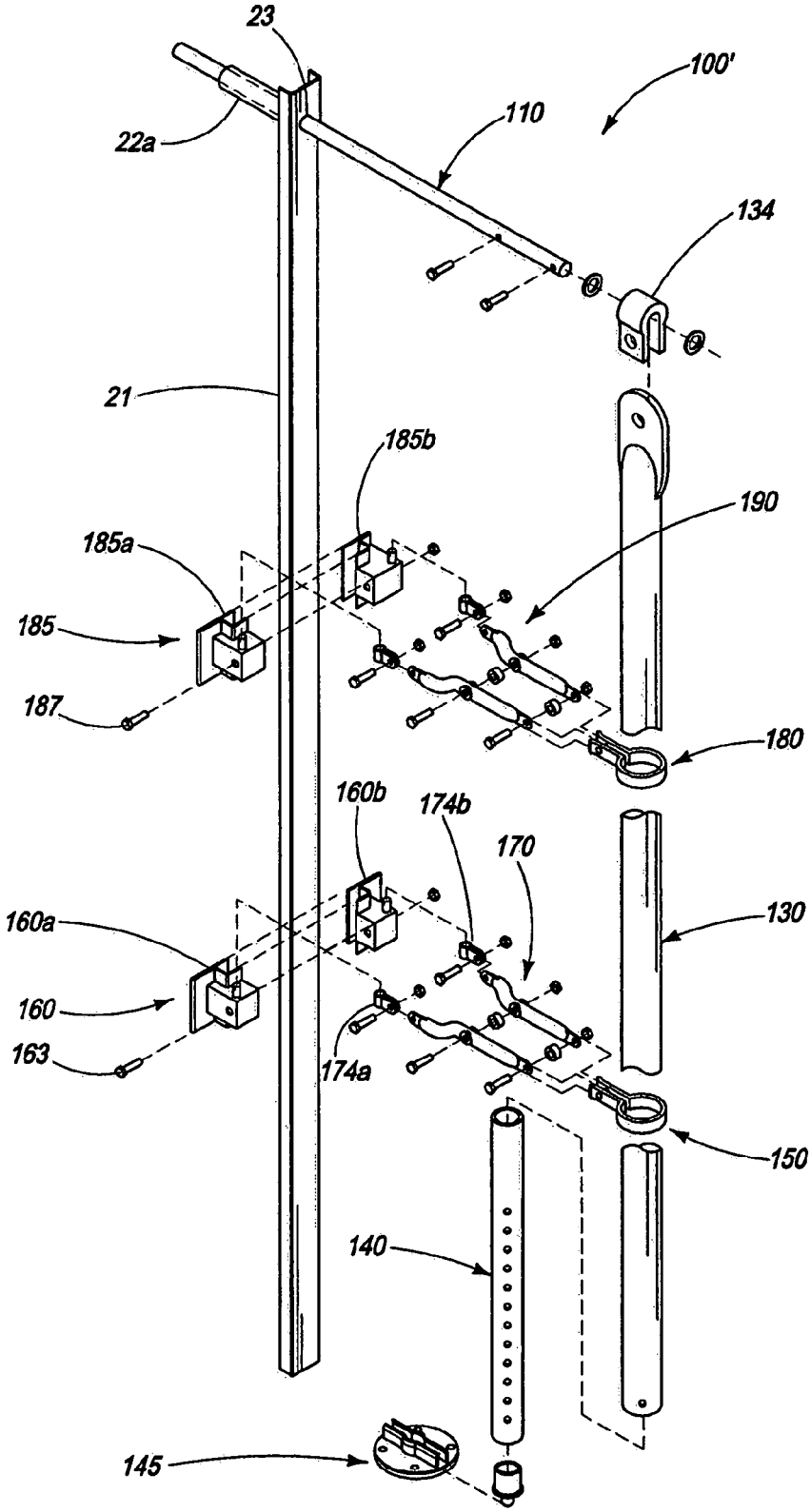
FIG. 7 is an exploded view of the ladder stabilization device and ladder of FIG. 6.
Figure 8:
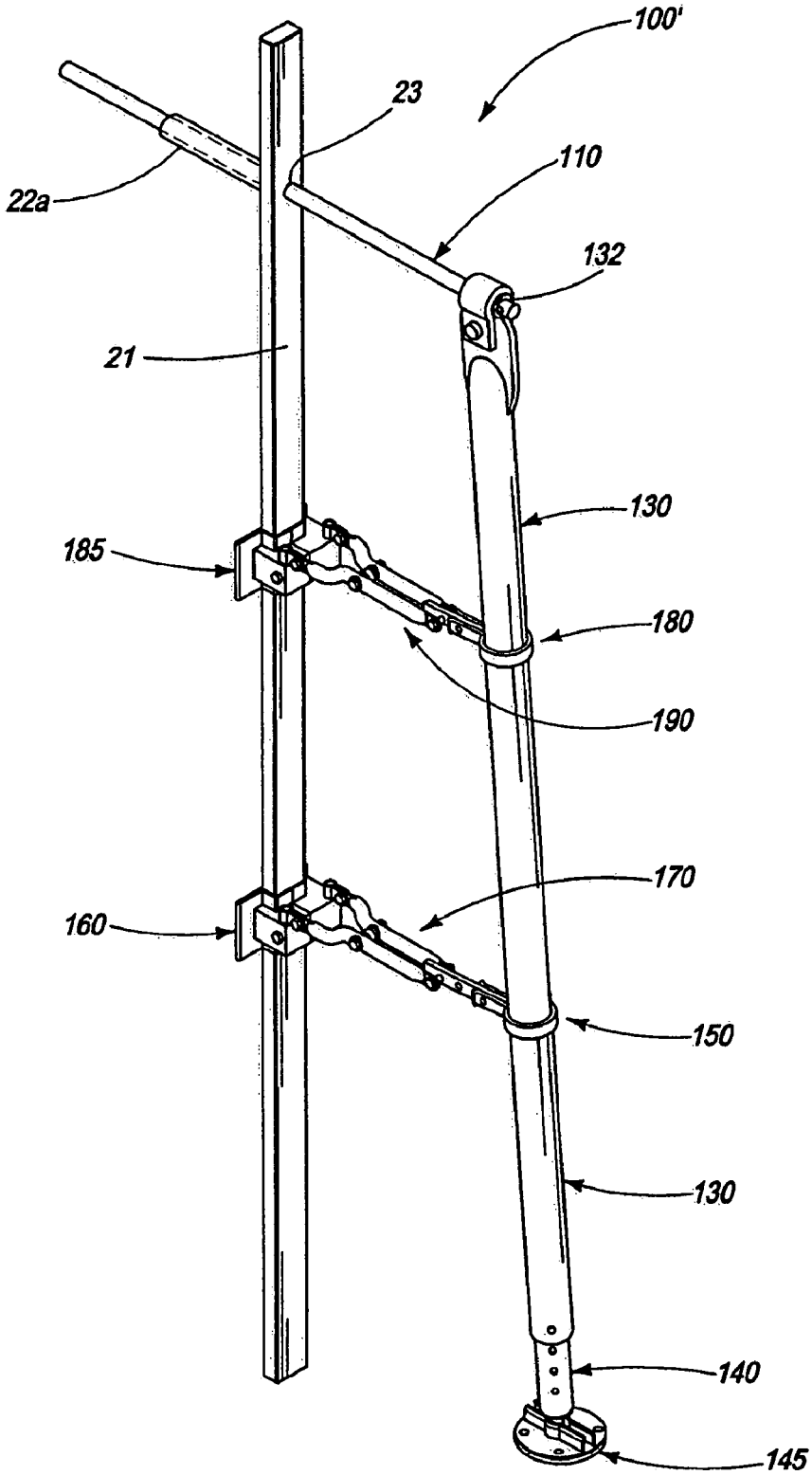
FIG. 8 is a perspective view of the ladder stabilization device and ladder of FIG. 6.
Figure 9:
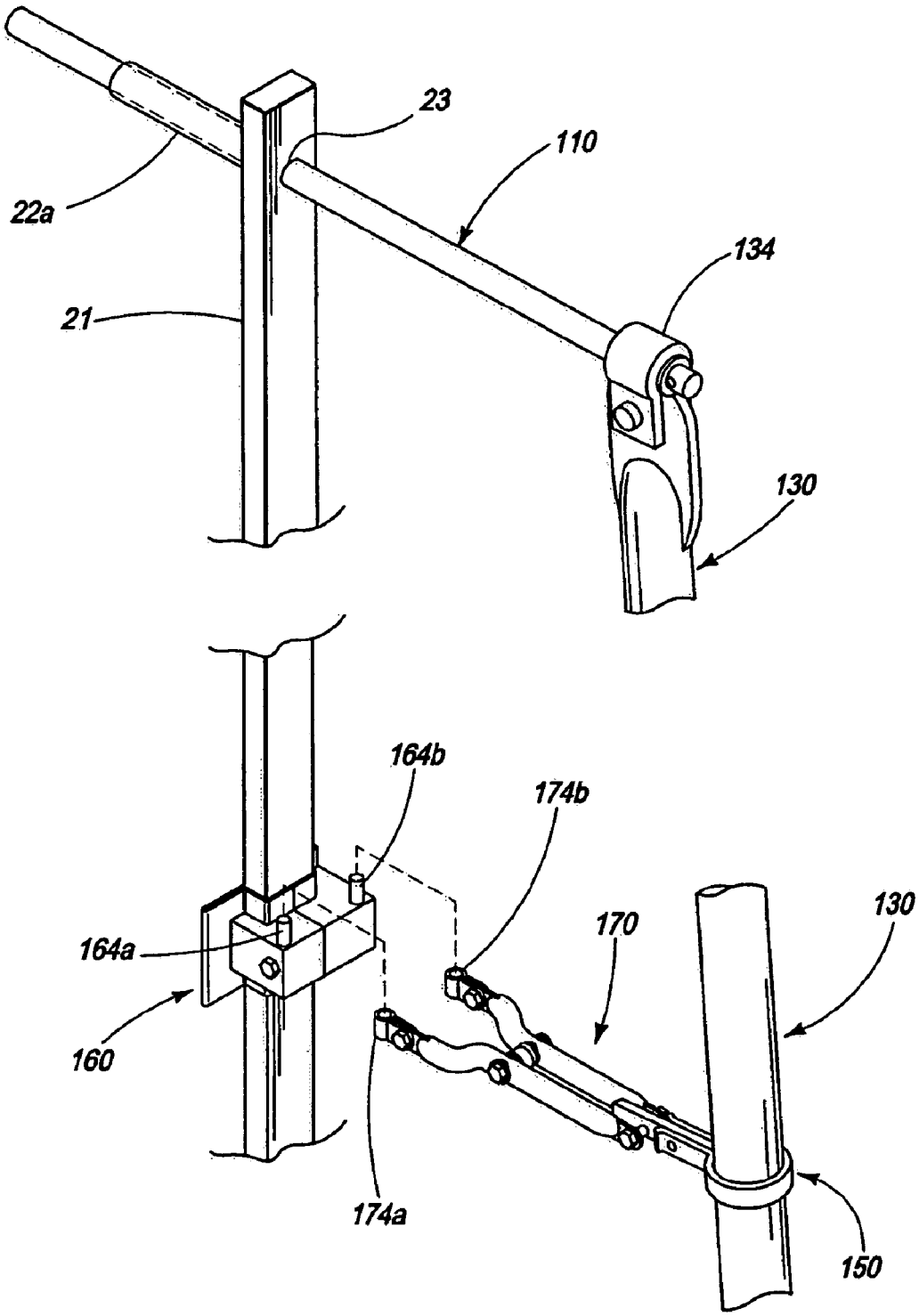
FIG. 9 is a broken view of the ladder stabilization device and ladder of FIG. 6.

In an exemplary method of use, the ladder 20 may be stabilized by operatively coupling the upper shaft 110 to the ladder upper end 20*a* (e.g., by passing the upper shaft 110 through the ladder aperture 23), rotatably coupling the upper shaft 110 to the outer leg upper end 130*a* (e.g., through the outer leg strap 134), coupling the lower bracket 160 to the ladder leg 21, coupling the lower coupler 150 to the outer leg 130, coupling the lower strut first end 170*a* to the lower bracket 160, coupling the lower strut second end 170*b* to the lower coupler 150, coupling the intermediate bracket 185 to the ladder leg 21, coupling the intermediate coupler 180 to the outer leg 130, coupling the intermediate strut first end 190*a* to the intermediate bracket 185, coupling the intermediate strut second end 190*b* to the intermediate coupler 180, and telescopically adjusting the inner leg 140 relative to the outer leg 130 so that the foot 145 is positioned on a ground surface. To store or move the ladder 20 and the ladder stabilization device 100', the lower strut 170 and the lower bracket 160 may be uncoupled, the lower strut 170 may be rotated about the lower coupler 150 so that the lower strut 170 is generally parallel to and adjacent the outer leg 130, the intermediate strut 190 and the intermediate bracket 185 may be uncoupled, the intermediate strut 190 may be rotated about the intermediate coupler 180 so that the intermediate strut 190 is generally parallel to and adjacent the outer leg 130, and the outer leg 130 may be rotated about the upper shaft 110. As can be seen in FIG. 6, two ladder stabilization devices 100' may be used for a single ladder 20, and the two stabilization devices 100' may share a single upper shaft 110.

Notably, both the ladder stabilization device 100 and the ladder stabilization device 100' work with pre-existing ladders, and the ladder stabilization device 100' may be, in effect, the ladder stabilization device 100 without the upper bracket 120.

Those skilled in the art appreciate that variations from the specified embodiments disclosed above are contemplated herein and that the described embodiments are not limiting. The description should not be restricted to the above embodiments, but should be measured by the following claims.

What is claimed is:

1. A stabilization device for use with folding or extension ladders, the device comprising:

an upper shaft for operative coupling to an upper end of the ladder;

an elongate outer leg presenting upper and lower ends, the upper end having an aperture for receiving the upper shaft in a generally horizontal direction;

an elongate inner leg positioned in the outer leg and configured for telescoping extension relative to the outer leg;

means for maintaining the inner leg at a plurality of predetermined positions relative to the outer leg;

a foot coupled to a lower end of the inner leg for placement on a ground surface;

a lower bracket for attachment to a leg of the ladder;

a lower coupler for attachment to the outer leg; and a lower strut having first and second ends, the first end being attachable to the lower bracket and the second end being attachable to the lower coupler to operatively couple the outer leg to the ladder leg and maintain a preselected distance between the outer leg and the ladder leg;

wherein the lower bracket has first and second upwardly-extending pins; and wherein the lower strut first end has first and second straps for encircling the first and second pins, respectively, to couple the lower strut to the lower bracket.

2. The device of claim 1, wherein the lower strut has an elongate portion rotatably coupled to the first and second straps and rotatably coupled to the lower coupler.

3. The device of claim 2, wherein the lower strut elongate portion includes two distinct elongate members.

4. The device of claim 1, wherein the first and second straps are constructed of a material selected from the group consisting of rubber, plastic, composite, and metal.

5. The device of claim 1, wherein:

the lower bracket has separable first and second sections configured for collectively encircling the ladder leg when combined;

the lower bracket first and second sections define aligned holes; and a bolt selectively passes through the aligned holes to combine the lower bracket first and second sections and couple the first and second sections to the ladder leg through friction.

6. The device of claim 1, wherein the lower coupler includes a strap sized to encircle the outer leg.

7. The device of claim 1, wherein:

the aperture at the outer leg upper end is defined by a strap sized to receive the upper shaft, the strap being rotatably coupled to a tubular portion of the outer leg;

the upper shaft defines two holes spaced apart to receive the outer leg strap therebetween; and fasteners pass through the upper shaft holes when the outer leg strap is between the upper shaft holes to couple the upper shaft to the outer leg strap.

8. The device of claim 1, wherein:

the ladder has opposed legs and a plurality of steps spanning therebetween;

an aperture passes through the opposed ladder legs and an uppermost step; and the upper shaft is sized to pass through the ladder aperture to operatively couple the upper shaft and the ladder upper end.

9. The device of claim 1, wherein:

the ladder has opposed legs and a plurality of steps spanning therebetween;

an aperture does not pass through the opposed ladder legs and an uppermost step; and an upper bracket is attachable to the upper shaft and one of the ladder legs to operatively couple the upper shaft and the ladder upper end.

10. The device of claim 9, wherein:

the upper bracket has separable first and second sections configured for collectively encircling one of the ladder legs when combined;

the upper bracket first and second sections define aligned holes;

a bolt selectively passes through the aligned holes to combine the upper bracket first and second sections and couple the first and second sections to one of the ladder legs through friction; and one of the upper bracket sections has a flange with a hole for selectively receiving the upper shaft to operatively couple the upper shaft and the ladder upper end.

11. The device of claim 1, wherein:

the ladder has opposed legs and a plurality of steps spanning therebetween;

an upper bracket is attachable to the upper shaft and one of the ladder steps to operatively couple the upper shaft and the ladder upper end;

the upper bracket has separable first and second sections configured for collectively encircling one of the ladder steps when combined;

the upper bracket first and second sections define aligned holes;

a bolt selectively passes through the aligned holes to combine the upper bracket first and second sections and couple the first and second sections to one of the ladder steps through friction; and one of the upper bracket sections has a flange with a hole for selectively receiving the upper shaft to operatively couple the upper shaft and the ladder upper end.

12. The device of claim 1, wherein:

the lower strut is rotatable about the lower coupler when the lower strut is not attached to the lower bracket so that the lower strut may be generally parallel to the outer leg;

the aperture at the outer leg upper end is defined by a strap sized to receive the upper shaft, the strap being rotatably coupled to a tubular portion of the outer leg so that the outer leg may be generally parallel to the ladder leg when the lower strut is not attached to the lower bracket;

the upper shaft defines two holes spaced apart to receive the outer leg strap therebetween; and fasteners pass through the upper shaft holes when the outer leg strap is between the upper shaft holes to couple the upper shaft to the outer leg strap.

13. The device of claim 1, wherein a ball and socket connection couples the foot to the lower end of the inner leg.

14. The device of claim 1, wherein the upper shaft and the lower strut are dimensioned to maintain the outer leg at a 15 to 30 degree angle offset from the vertical when the lower strut is attached to the lower bracket and the lower coupler and the upper shaft is coupled to the outer leg.

15. The device of claim 1, further comprising:

an intermediate bracket for attachment to the ladder leg;

an intermediate coupler for attachment to the outer leg; and an intermediate strut having a first end being attachable to the intermediate bracket and a second end being attachable to the intermediate coupler to operatively couple the outer leg to the ladder leg and maintain a preselected distance between the outer leg and the ladder leg.

16. The device of claim 15, wherein:

the lower strut is rotatable about the lower coupler when the lower strut is not attached to the lower bracket so that the lower strut may be generally parallel to the outer leg;

the intermediate strut is rotatable about the intermediate coupler when the intermediate strut is not attached to the intermediate bracket so that the intermediate strut may be generally parallel to the outer leg; and the aperture at the outer leg upper end is defined by a strap sized to receive the upper shaft, the strap being rotatably coupled to a tubular portion of the outer leg so that the outer leg may be generally parallel to the ladder leg when the lower strut is not attached to the lower bracket and the intermediate strut is not attached to the intermediate bracket.

17. A stabilization device for use with folding or extension ladders, said device comprising:

an upper shaft for operative coupling to an upper end of the ladder;

an elongate outer leg presenting upper and lower ends, the upper end having an aperture for receiving the upper shaft in a generally horizontal direction;

an elongate inner leg positioned in the outer leg and configured for telescoping extension relative to the outer leg;

at least one element selected from the group consisting of a pin and a clamp for maintaining the inner leg at a plurality of positions relative to the outer leg;

a foot coupled to a lower end of the inner leg for placement on a ground surface;

a lower bracket for attachment to a leg of the ladder;

a lower coupler for attachment to the outer leg; and a lower strut having first and second ends, the first end being attachable to the lower bracket and the second end being attachable to the lower coupler to operatively couple the outer leg to the ladder leg and maintain a preselected distance between the outer leg and the ladder leg;

wherein the lower bracket has first and second upwardly-extending pins; and wherein the lower strut first end has first and second straps for encircling the first and second pins, respectively, to couple the lower strut to the lower bracket.

* * * * *